United States Patent [19]

King

[11] Patent Number: 4,982,795

[45] Date of Patent: Jan. 8, 1991

[54] METHOD AND APPARATUS FOR SUPPORTING ONE TUBULAR MEMBER WITHIN ANOTHER

[75] Inventor: Christopher R. King, Amberley, England

[73] Assignee: Cooper Industries, Inc., Houston, Tex.

[21] Appl. No.: 431,521

[22] Filed: Nov. 3, 1989

[30] Foreign Application Priority Data

Nov. 7, 1988 [EP] European Pat. Off. ..... 8826005.4

[51] Int. Cl.[5] ..... E21B 23/00

[52] U.S. Cl. ..... 166/382; 166/208; 166/212; 166/217; 175/423

[58] Field of Search ..... 166/382, 85, 208, 212, 166/216, 217, 242; 175/423

[56] References Cited

U.S. PATENT DOCUMENTS

| | | | |
|---|---|---|---|
| 3,098,525 | 7/1963 | Haeber | 166/66.5 |
| 3,468,559 | 8/1969 | Ahlstone | 285/18 |
| 3,977,473 | 8/1976 | Page, Jr. | 166/212 |
| 4,067,388 | 1/1978 | Mouret et al. | 166/208 |
| 4,249,601 | 2/1981 | White | 166/208 |
| 4,582,133 | 4/1986 | Tambs | 175/423 |
| 4,691,781 | 9/1987 | Gano | 166/382 |
| 4,848,462 | 7/1989 | Allwin | 166/208 |

*Primary Examiner*—Ramon S. Britts
*Assistant Examiner*—Terry Lee Melius

[57] ABSTRACT

An apparatus for supporting a tubular member such as a casing string within another tubular member such as a wellhead, comprising a generally tubular tool which can be lowered into the annular space between said members, a slip carrier supported from said tool and a slip assembly carried by said slip carrier, said slip assembly including a slip bowl which can be supported against one of said tubular members and one or more slip elements which can be urged into wedging engagement between said slip bowl and the other tubular elements, the slip elements normally being supported by said slip carrier in a non-engaged position and said tool including means operable to urge the slip elements into said wedging engagement. A method of supporting a casing string within a well including the steps of landing the slip bowl on the casinghead shoulder, actuating the tool to force the slip element into engagement between the casing and the slip bowl and retrieving the tool and slip carrier.

4 Claims, 9 Drawing Sheets

METHOD AND APPARATUS FOR SUPPORTING ONE TUBULAR MEMBER WITHIN ANOTHER

BACKGROUND

This invention relates to apparatus for supporting a first tubular member within a second tubular member. The apparatus has particular application to drilling equipment where, for example, it is sometimes necessary to support a casing string within a wellhead.

During the formation of drilling installations, successive links of casing are run into a well through wellhead equipment. Situations can arise in which a casing string cannot be run to its full depth and becomes stuck. In such a situation it is necessary to suspend the casing string within the wellhead. This can be a problem with conventional equipment since a blowout preventer is usually located above the wellhead and, because of the presence of casing couplings it is not normally possible to gain access to the annular space between the wellhead and the casing without removal of the blowout preventer. This is undesirable.

The J. A. Haeber U.S. Pat. No. 3,098,525 discloses a running tool for running and retrieving a well casing hanger into and from an underwater well casinghead. The tool includes a piston operated latch to connect the casing hanger in the casinghead. A latching pin responds to the latch segments to hold slips in an inactive position until the running tool is released and then the slips move downward on the exterior of the casing hanger to engage the interior of the casing head because they are biased downwardly by springs.

The P. A. White U.S. Pat. No. 4,249,601 discloses a liner hanger running and setting tool which includes a hydraulic piston to transmit relative longitudinal movement to two movable tubular members to set the gripping slips which anchor the hanger in the well.

The A. G. Ahlstone U.S. Pat. No. 3,468,559 discloses the use of hydraulically set seal and packoff.

The E. M. Mouret et al U.S. Pat. No. 4,067,388 discloses a tool for running underwater casing hangers which has a resilient split ring to connect the tool to the hanger and utilizes hydraulics or rotation to disconnect the tool from the hanger.

SUMMARY

The present invention relates to apparatus which can be lowered into the space between, for example, the wellhead and a casing without the need for removing the blowout preventer.

According to the present invention there is provided apparatus for supporting a tubular member such as a casing string within another tubular member such as a wellhead, comprising a generally tubular tool which can be lowered into the annular space between said members, a slip carrier supported from said tool and a slip assembly carried by said slip carrier, said slip assembly including a slip bowl which can be supported against one of said tubular members and one or more slip elements which can be urged into wedging engagement between said slip bowl and the other tubular elements, the slip elements normally being supported by said slip carrier in a non-engaged position and said tool including means operable to urge the slip elements into said wedging engagement.

The tool may be hydraulically operable.

The slip assembly may include a plurality of angularly spaced slip elements. The slip elements may be coupled to the slip carrier by shear pins. The slip bowl may be coupled to the slip carrier by further shear pins, each such further shear pin being arranged to shear at a higher shearing force than that at which the shear pins supporting the slip elements shear.

The tool may comprise inner and outer tubular sections which can be moved axially relative to each other in response to hydraulic pressure applied thereto, one of said tubular elements being arranged to urge said slip elements downwardly into frictional engagement with said slip bowl.

According to another aspect of the present invention there is provided a method of supporting a casing string within a wellhead which comprises lowering an apparatus of the type defined above into the annular space between the casing and the wellhead so that the slip bowl is landed on a shoulder or similar supporting surface of the wellhead, actuating said tool so that said slip elements are forced into wedging engagement between the casing and the slip bowl and retrieving the tool and slip carrier.

BRIEF DESCRIPTION OF THE DRAWINGS

The invention will be described now by way of example only, with particular reference to the accompanying drawings. In the drawings.

DESCRIPTION OF THE PREFERRED EMBODIMENT

Figure 1:
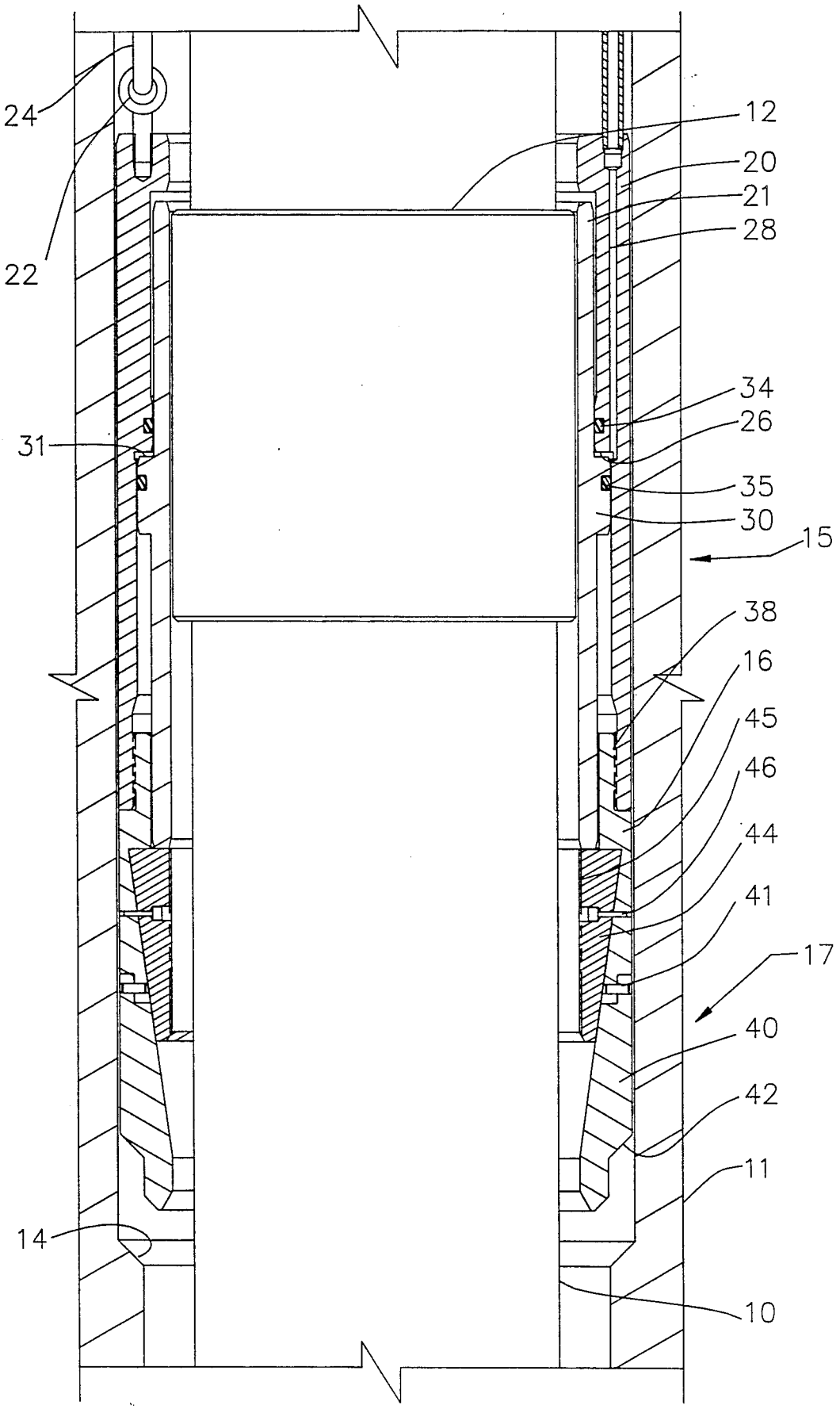
FIG. 1 is a sectional view through a wellhead structure, illustrating apparatus in accordance with the present invention with the casing and tool approaching the landing seat within the wellhead.

FIG. 1 shows a tubular casing 10 extending through a tubular wellhead 11. The casing includes a conventional casing coupling 12. The internal surface of the wellhead is formed with a landing shoulder 14.

Apparatus in accordance with the present invention can be lowered into the annular space between the casing 10 and the wellhead 11. This apparatus comprises a tool, shown generally at 15, a slip carrier 16 supported from the tool, and a slip assembly shown generally at 17 which is carried by the slip carrier 16. The tool 15 comprises inner and outer relatively movable tubular members 20, 21. The upper end portion of the outer tubular member 20 has connected thereto a plurality of angularly spaced eyebolts 22 through which extend cables 24. The cables extend up to surface equipment to enable the apparatus to be lowered to the position shown in FIG. 1. The outer tubular member 20 is also formed with an internal shoulder 26. A bore 28 extends axially through the outer tubular member and opens at a position adjacent the shoulder 26. The upper end of the bore 28 is connected to a hydraulic supply line which extends upwardly to surface equipment.

The inner tubular member 21 is formed with an outwardly extending annular portion 30 which defines a shoulder 31 disposed beneath the shoulder 26. The shoulders 31 and 26 define a space into which hydraulic fluid can be forced under pressure through the conduit 28. This space is sealed by annular seals 34, 35.

The lower portion of the outer tubular member 20 is threaded at 38, this thread engaging a similar thread on an upper portion of the slip carrier 16.

The slip assembly 17 comprises an annular generally wedge-shaped slip bowl 40 which is coupled to the slip carrier 16 by shear pins 41. The outer surface of the slip bowl 40 is formed with a shoulder 42 which is shaped to conform with the shoulder 14, formed on the internal surface of the wellhead. The slip assembly 17 also comprises a plurality of angularly spaced, generally wedge-shaped slips 44. Each slip 44 is coupled to the slip carrier 16 by shear pin 46. The shear pins 46 are designed to shear at a shear force which is less than the shear force required to shear the pins 41. The inner cylindrical surface of each slip 44 has upwardly facing teeth 45 formed thereon and the outer cylindrical surface has downwardly facing teeth formed thereon.

Figure 7:
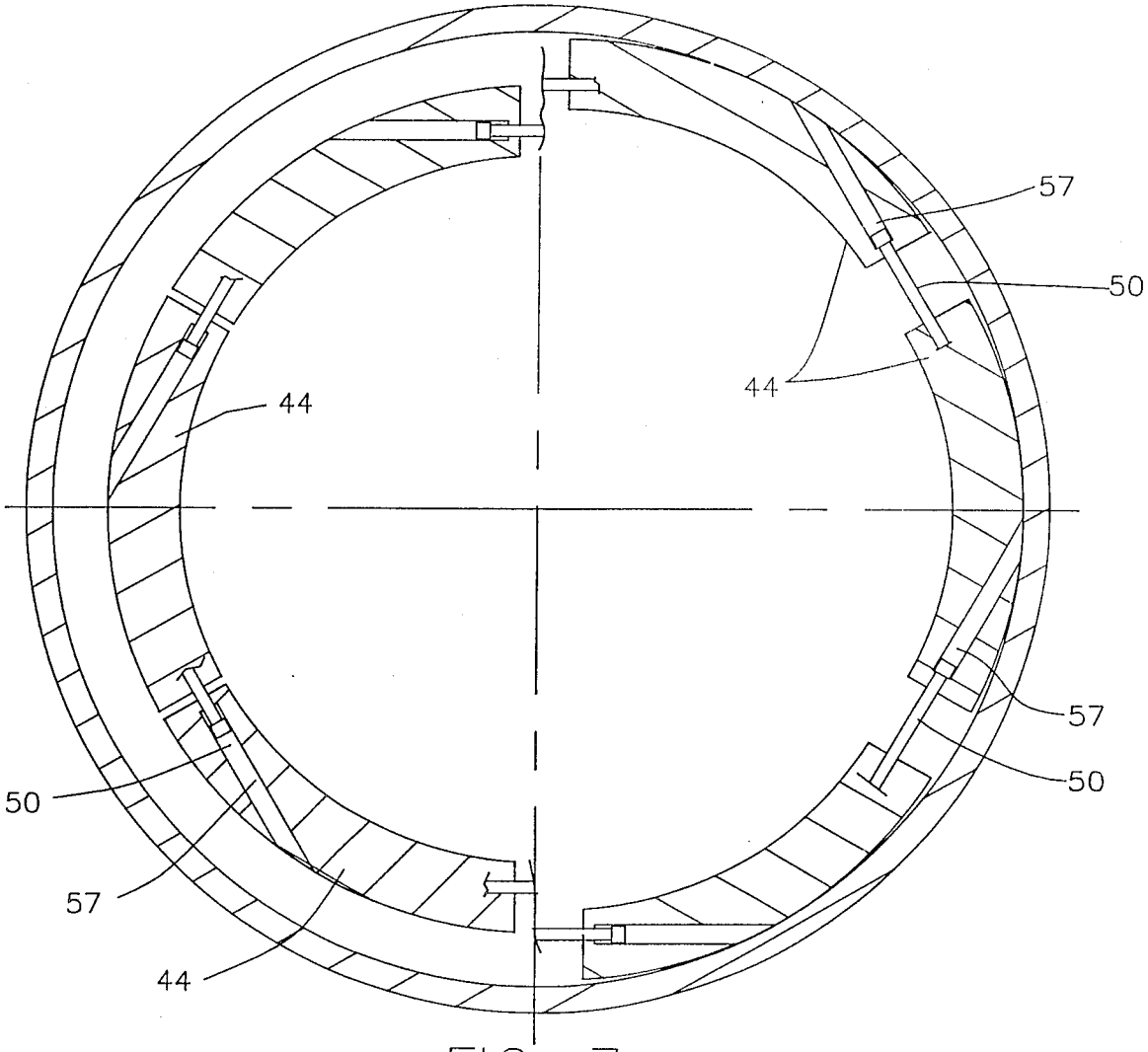
FIG. 7 is a transverse sectional view of the slips with the left hand portion illustrating the slips in unset or retracted position and the right hand portion illustrating the slips in set position.

As can be seen in FIG. 7 there are six slips 44 spaced angularly around a central axis. The slips are guided by threaded pins 50 which extend between adjacent slips. The heads of the pins can slide in bores 57. The right hand side of FIG. 7 shows the retracted positions of the slips while the left hand side shows the slips after having been moved to their gripping position which will be described below.

Figure 2:
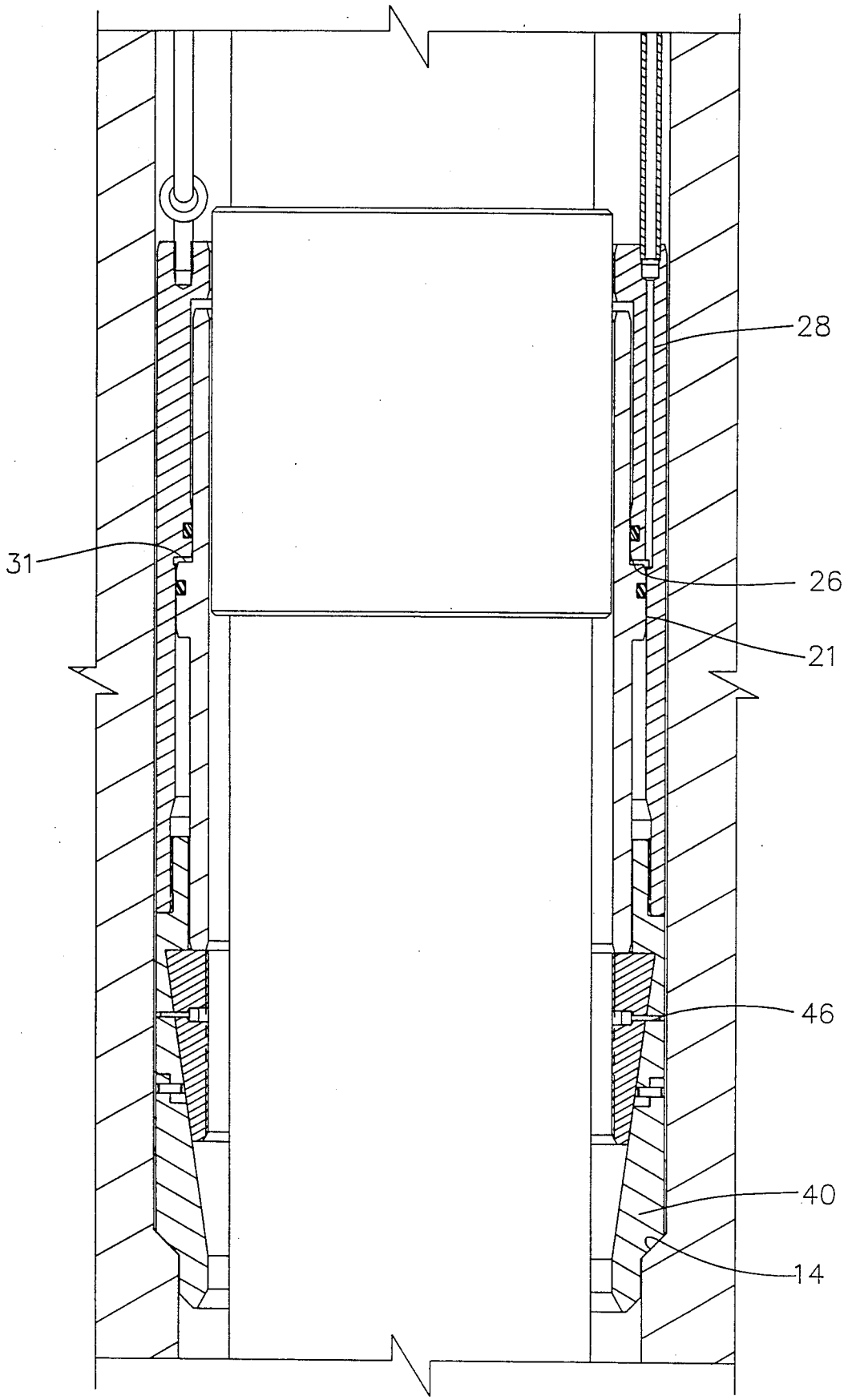
FIG. 2 is a similar view showing the tool landed on the landing seat within the wellhead.
Figure 3:
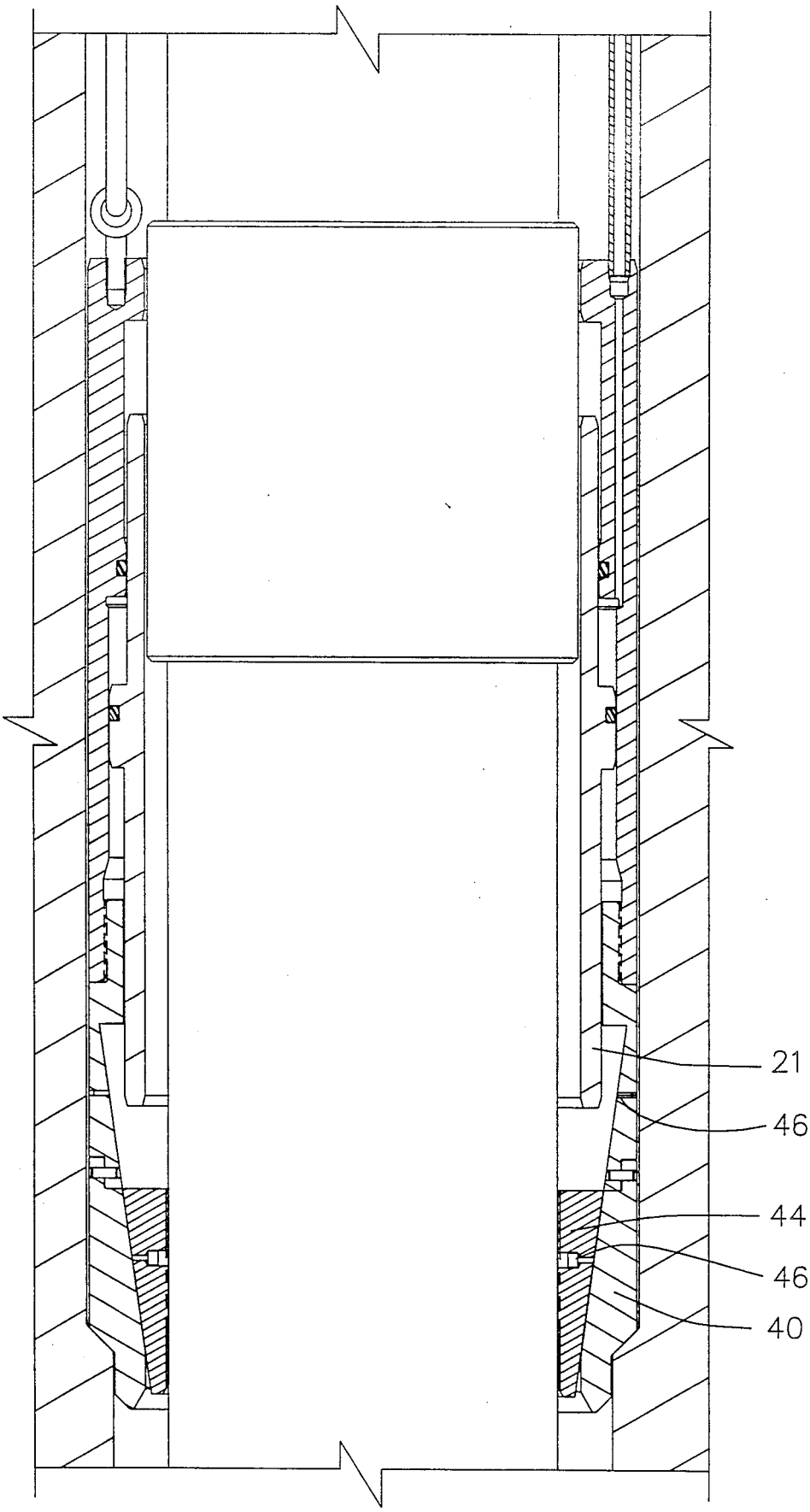
FIG. 3 is another similar view showing the release of the slips for engagement with the exterior of the casing.
Figure 4:
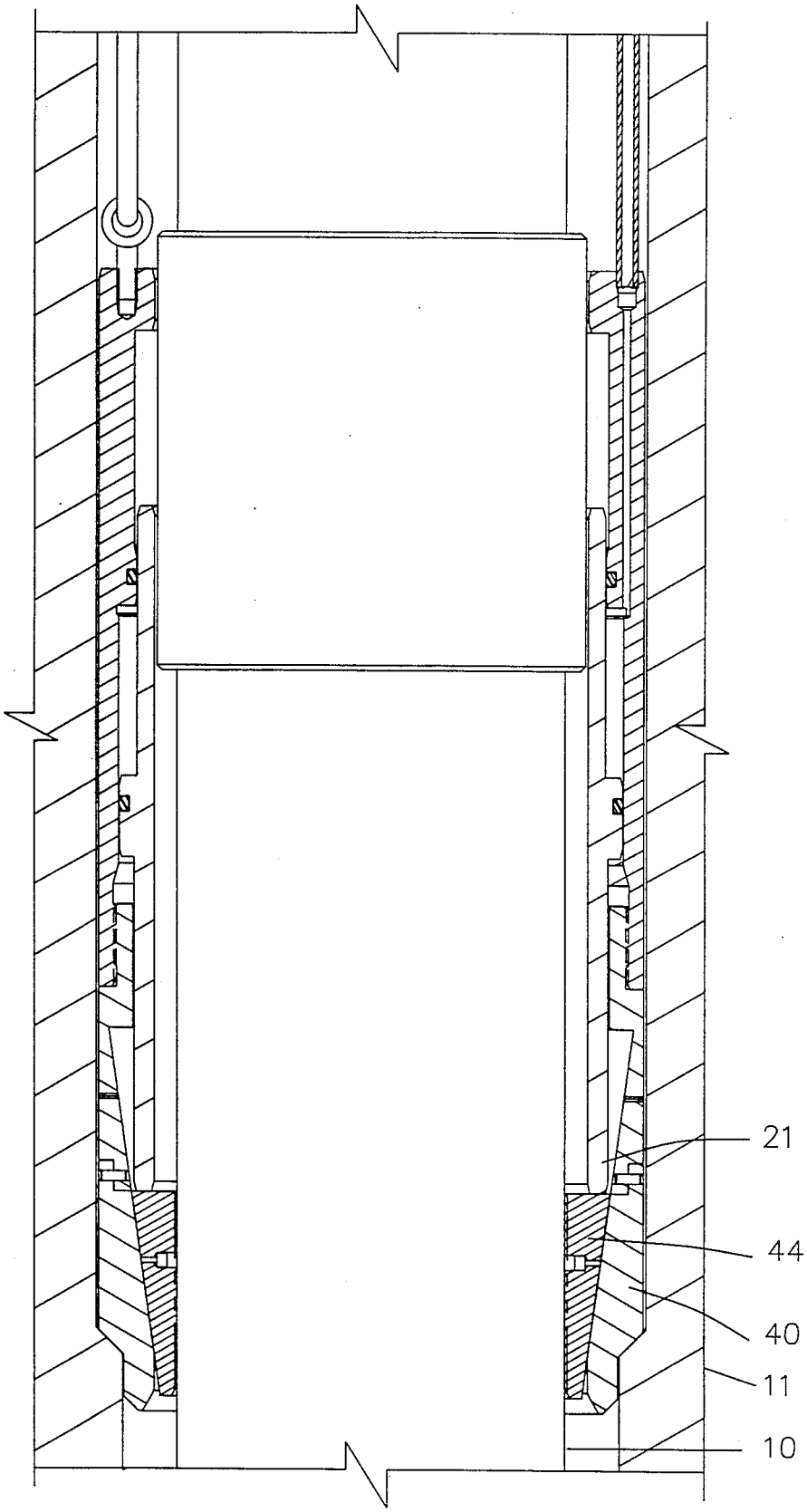
FIG. 4 is another similar view showing the urging of the slips into tight gripping engagement with the casing.

In use, the apparatus is lowered into the annular space between the casing 10 and wellhead 11. It will be appreciated that the structure of the apparatus allows it to be lowered past items such as casing coupling 12 and blowout preventers (not shown). The apparatus is lowered until the slip bowl 40 becomes landed on the shoulder 14 as shown in FIG. 2. At this point hydraulic pressure is applied via conduit 28 to the space between the shoulders 31 and 26. This causes a downward force to be applied to the inner tubular member 21 which causes shearing of the pins 46. Hence, the slips 44 are caused to move downwardly as illustrated in FIG. 3. The hydraulic pressure causes the slips 44 to become wedged between the casing and the slip bowl 40 as shown in FIG. 4 of the drawings. The teeth 45 on the slips 44 grip the casing surface.

Figure 5:
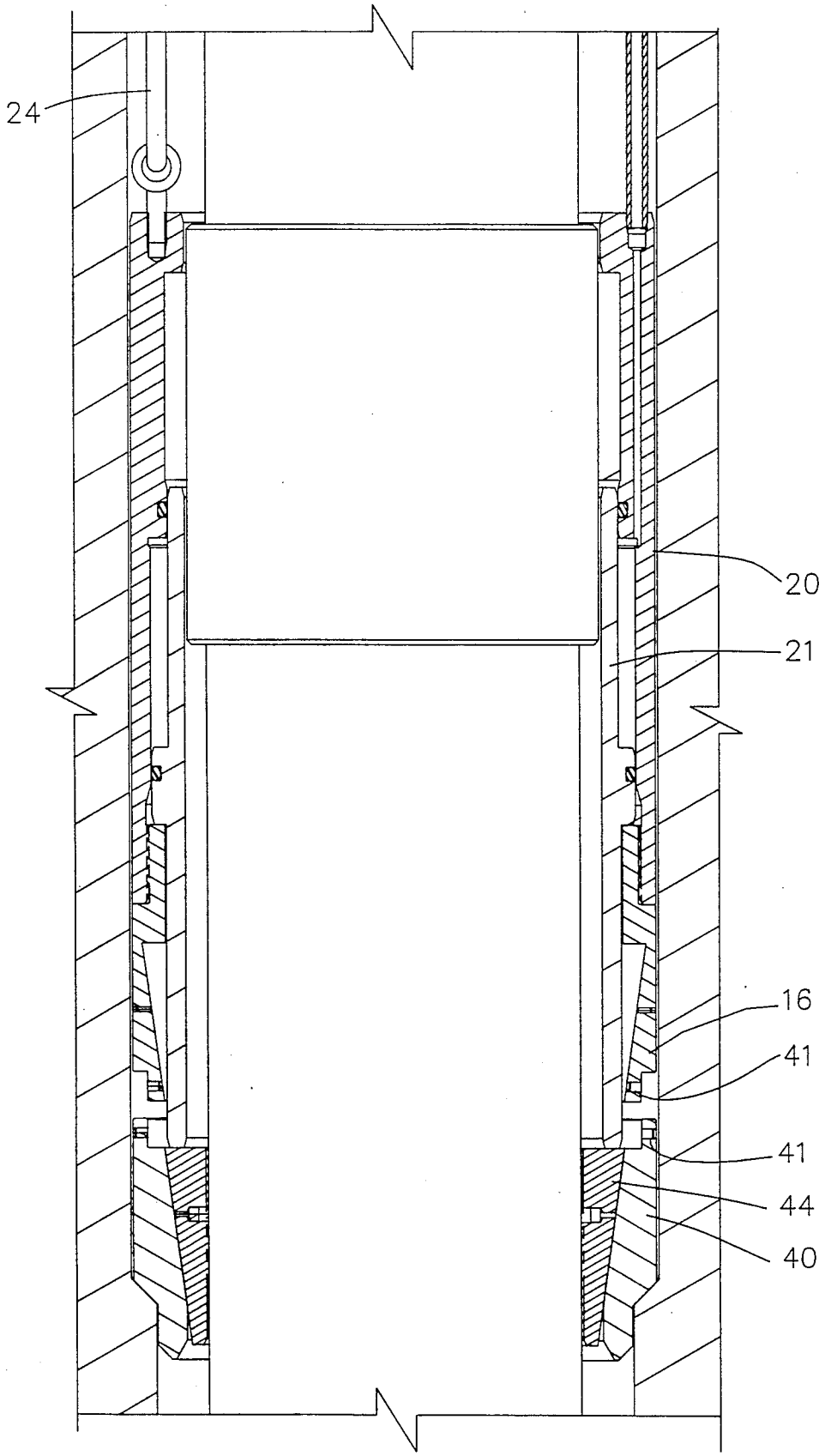
FIG. 5 is another similar view illustrating the disengagement of the tool from the slip bowl.
Figure 6:
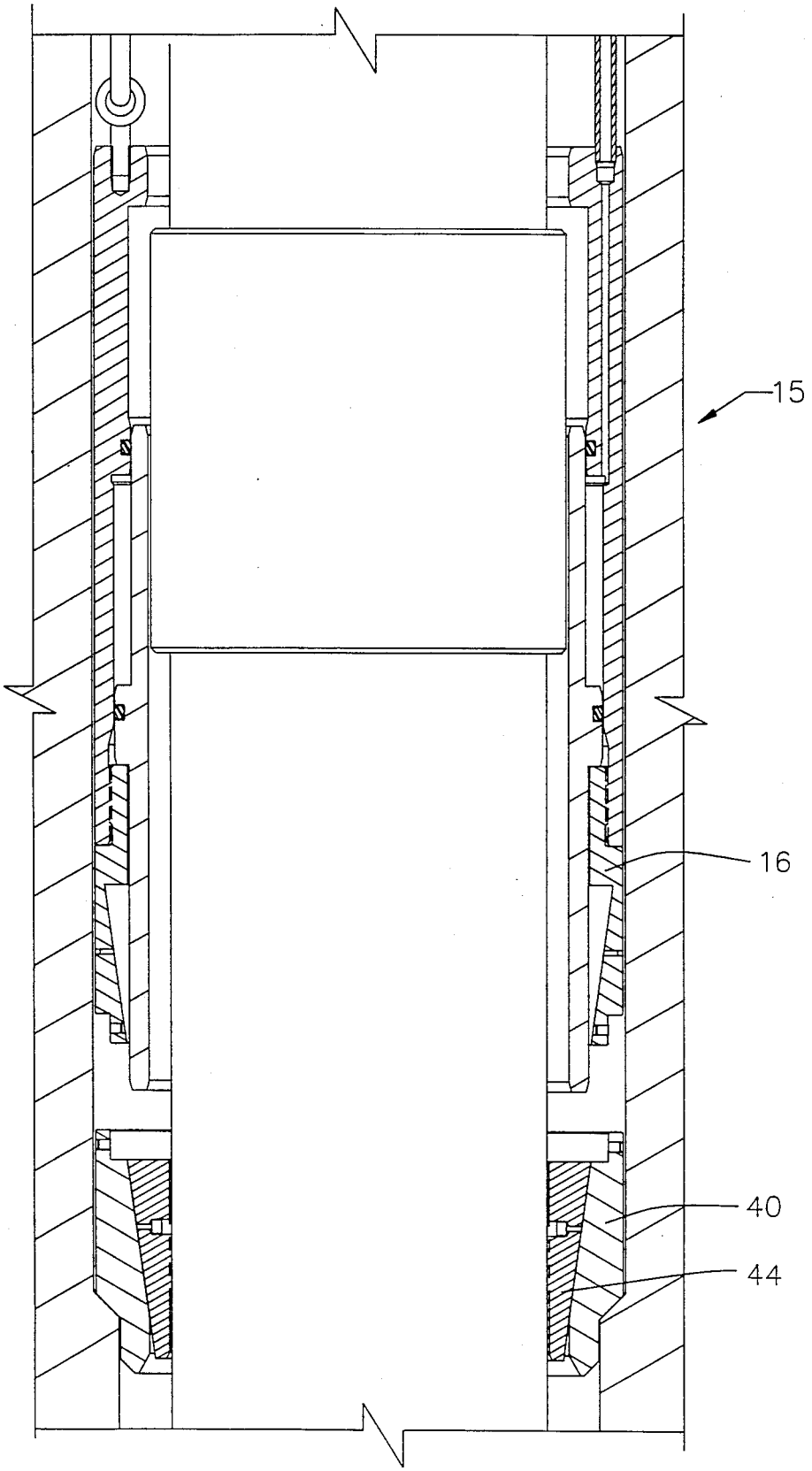
FIG. 6 is another similar view illustrating the retrieval of the tool from within the wellhead.

The next step is to increase the hydraulic pressure applied between the inner and outer tubular members 21 and 20. It will be appreciated that in the position shown in FIG. 4, the inner tubular member 21 cannot move downwardly any further and the increased hydraulic pressure generates an upward force on the outer tubular member 20 which causes shear pins 41 to shear. Thus, the slip carrier 16 becomes detached from the slip bowl 40 as shown in FIG. 5 of the drawings. Hence the tool and slip carrier can be retrieved, as illustrated in FIG. 6 of the drawings. This completes the location of the slip assembly in the space between the casing and the wellhead so that the casing becomes supported by the wellhead.

If necessary, a seal assembly can subsequently be located above the slip assembly as will be apparent to those skilled in the art.

Figure 8:
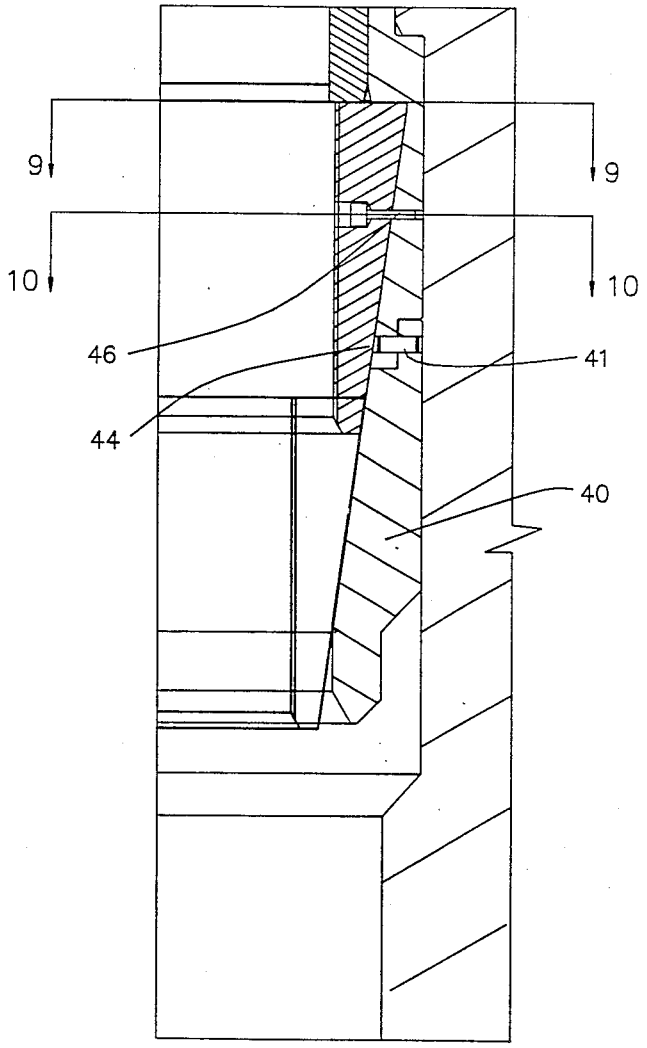
FIG. 8 is a longitudinal sectional view of a modified form of slip arrangement.
Figures 9, 10:
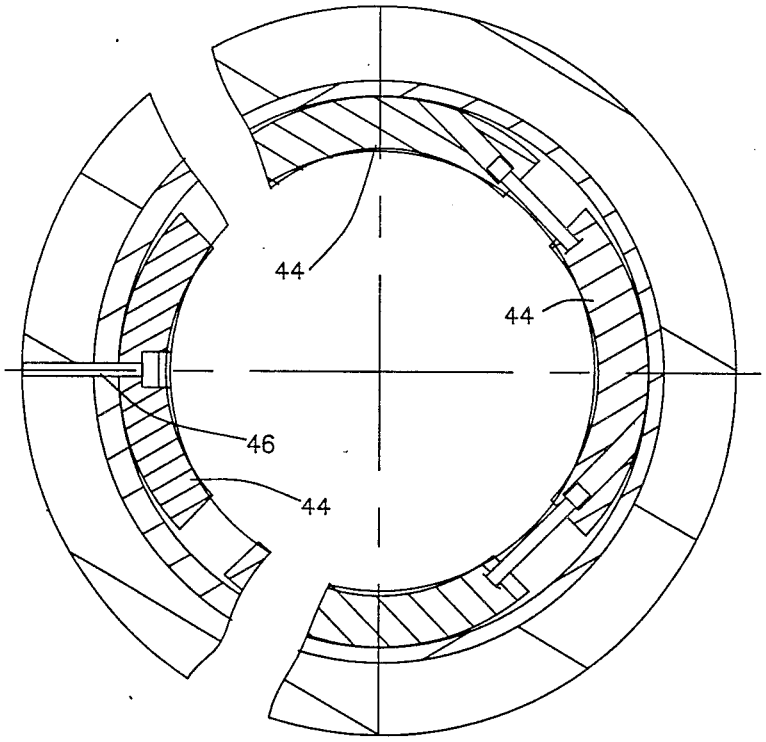
FIG. 9 is a partial sectional view taken along line 9—9 showing the modified form of slip arrangement.
FIG. 10 is another partial sectional view taken along line 10—10 showing the modified form of slip arrangement.

FIG. 8 illustrates an alternative arrangement in which four slips are employed.

What is claimed is:

1. An apparatus for supporting a tubular member such as a casing string within another tubular member such as a wellhead, wherein there is an annular space between the members, comprising a generally tubular tool which can be lowered into the annular space between said members, a slip carrier supported from said tool and a slip assembly carried by said slip carrier, said slip assembly including a slip bowl which can be supported against one of said tubular members and a plurality of angularly spaced slip elements which can be urged into wedging engagement between said slip bowl and the other tubular member, the slip elements normally being supported by said slip carrier in a non-engaged position, shear pins releasably connecting the slip elements to the slip carrier, further shear pins coupling the slip bowl to the slip carrier, each such further shear pin being arranged to shear at a higher shearing force than that at which the shear pins connecting the slip elements to the slip carrier shear, and said tool including means operable to urge the slip elements into said wedging engagement.

2. The apparatus as set forth in claim 1 wherein the tool is hydraulically operated and including means for delivering hydraulic fluid under pressure to said tool.

3. The apparatus as set forth in claim 2 wherein the tool includes inner and outer tubular sections which can be moved axially relative to each other in response to hydraulic pressure applied thereto, one of said tubular members being arranged to urge said slip elements downwardly into gripping engagement with said casing and into frictional engagement within said slip bowl.

4. A method of supporting a casing string within a wellhead with an annular space therebetween and an annular landing shoulder on said wellhead in said annular space which includes the steps of lowering a generally tubular tool into the annular space between the casing and the wellhead, said tubular tool having a slip carrier and a slip assembly with a slip bowl and a plurality of angularly spaced slip elements which are carried by said slip bowl, first shear pins releasably connecting the slip elements to the slip bowl, second shear pins releasably connecting the slip bowl to the slip carrier, said second shear pins having a higher shearing strength than said first shear pins, landing the slip bowl on the annular shoulder of the wellhead, actuating said tool to shear said first shear pins and to force said slip elements into wedging engagement between the casing and the slip bowl, and lifting the tool and slip carrier to shear said second shear pins to retrieve the tool and slip carrier.

* * * * *